US007979198B1

(12) United States Patent
Kim et al.

(10) Patent No.: US 7,979,198 B1
(45) Date of Patent: Jul. 12, 2011

(54) VEHICULAR TRAFFIC CONGESTION MONITORING THROUGH INTER-VEHICLE COMMUNICATION AND TRAFFIC CHAIN COUNTER

(75) Inventors: John Y. Kim, Centreville, VA (US); Thuy Tran, Fairfax, VA (US)

(73) Assignee: Sprint Spectrum L.P., Overland Park, KS (US)

( * ) Notice: Subject to any disclaimer, the term of this patent is extended or adjusted under 35 U.S.C. 154(b) by 872 days.

(21) Appl. No.: 11/961,385

(22) Filed: Dec. 20, 2007

(51) Int. Cl.
*G06G 7/76* (2006.01)

(52) U.S. Cl. ..... 701/117

(58) Field of Classification Search ..... 701/117–119; 340/907, 910, 933; 348/148–149
See application file for complete search history.

(56) References Cited

U.S. PATENT DOCUMENTS

| | | | | |
|---|---|---|---|---|
| 6,654,681 | B1 | 11/2003 | Kiendl | |
| 6,708,107 | B2 | 3/2004 | Impson et al. | |
| 7,106,219 | B2 * | 9/2006 | Pearce | 340/995.13 |
| 7,188,025 | B2 | 3/2007 | Hudson, Jr. | |
| 7,468,653 | B2 * | 12/2008 | Takahashi | 340/435 |
| 7,886,960 | B2 * | 2/2011 | Birjandi et al. | 235/376 |
| 2005/0030202 | A1 | 2/2005 | Tsuboi | |
| 2007/0083296 | A1 | 4/2007 | Tengler et al. | |
| 2007/0117525 | A1 | 5/2007 | Osafune | |

FOREIGN PATENT DOCUMENTS

EP 1296305 A1 3/2003

OTHER PUBLICATIONS

NewCarBuyingGuide.com, http://newcarbuyingguide.com/index.php/news/main/5684/event=view, Jan. 6, 2009, printed from the World Wide Web.

Wischhof, et al, "Information Dissemination in Self-organizing Intervehicle Networks", Mar. 2005, vol. 6, No. 1, IEEE Transactions on Intelligent Transportation Systems.

Xu, et al, "An Adaptive Dissemination Mechanism for Inter-Vehicle Communication-Based Decentralized Traffic Information Systems", Proceedings of the IEEE ITSC 2006, Sep. 17-20, 2006, pp. 1207-1213, Toronto, Canada.

Wischhof, et al, "SOTIS—A Self-Organizing Traffic Information System", 2003, pp. 2442-2446, Technical University of Hamburg, Department of Telecommunications, Hamburg, Germany.

Torrent-Moreno, "Inter-Vehicle Communications: Assessing Information Dissemination under Safety Constraints", Jan. 2007, 4th Annual IEEE/IFIP conference on WONS, Obergurgl, Austria.

Ziliaskopoulos, A., Zhang, J., "A Zero Public Infrastructure Vehicle Based Traffic Information System", Jan. 2003, In Proc. of the Transportation Research Board's 2003 Annual Meeting, National Academies, Washington D.C.

Wischhof, et al, "Adaptive Broadcast for Travel and Traffic Information Distribution Based on Inter-Vehicle Communication", Jun. 9-11, 2003, Proc. of IEEE Intelligent Vehicles Symposium 2003, Columbus, Ohio, USA.

* cited by examiner

*Primary Examiner* — Yonel Beaulieu

(57) ABSTRACT

Methods and systems are disclosed for monitoring vehicular traffic congestion through the use of inter-vehicle communication and traffic chain counters. Data packets including counter, vehicle identification, direction, location, and speed information are transmitted between vehicles via short-range wireless communications. A receiving vehicle edits a data packet if the data packet reflects that the receiving vehicle has not yet edited the packet and is traveling in substantially the same direction as the vehicle which transmitted the packet to the receiving vehicle. If a receiving vehicle is the last vehicle to edit a packet, the receiving vehicle transmits a reporting packet to a traffic monitoring server via long-range wireless communications.

21 Claims, 4 Drawing Sheets

VEHICULAR TRAFFIC CONGESTION MONITORING THROUGH INTER-VEHICLE COMMUNICATION AND TRAFFIC CHAIN COUNTER

BACKGROUND

As more vehicles travel the roads, and as those roads are expanded, the traffic patterns that vehicles create are increasingly complicated and far-flung. Traffic congestion may hinder drivers, for example by prolonging travel time, by increasing the likelihood of collisions, or by forcing drivers onto unfamiliar or undesirable travel routes. Therefore, information about traffic patterns, if collected and relayed to drivers in a timely manner, may allow drivers to adjust their travel plans to increase safety and convenience. Additionally, traffic monitoring may aid emergency responders by identifying both locations of collisions and routes by which emergency vehicles may travel to a collision.

Vehicles may be connected to wireless communications networks, and vehicles may be equipped with wireless transceivers configured to send and receive wireless signals. In a typical wireless network, a radio access network ("RAN") facilitates client devices, such as vehicles, communicating over the air interface. A RAN may be communicatively coupled to other types of networks, such as the Internet, and may include, among other components, base transceiver stations ("BTSs"), servers, and gateways, including switches. A BTS may comprise a cell tower with one or more antennas that radiate to define a cell and cell sectors. A BTS may serve client devices within the geographic coverage area corresponding to its cell, such that client devices within that area receive signals from and transmit signals to the BTS.

A server may receive signals from and transmit signals to a BTS. The server may also receive signals from and transmit signals to other network entities, possibly through network gateways, and a server may generate signals requesting or relaying information. Further, the server may process information contained in the signals it receives and may be equipped with memory, logic, and processing power sufficient for such information processing.

OVERVIEW

Methods and systems are herein disclosed to utilize wireless capabilities in vehicles to allow vehicles to communicate with each other to collect information that may then be sent to a traffic monitoring server. The information collected by the vehicles may take the form of a data packet that is generated by one vehicle and broadcast to nearby vehicles, and each vehicle that receives the packet may edit the packet and broadcast the packet to other vehicles. Vehicles may also broadcast a reporting packet to the traffic monitoring server.

An exemplary system supports the monitoring of vehicular traffic. This system comprises a plurality of vehicles that are capable of communicating using a RAN and a traffic monitoring server that is communicatively coupled to the RAN. Each vehicle of the plurality is equipped to send packets to and receive packets from other vehicles and to send packets to the traffic monitoring server. A packet, sent from a vehicle, contains at least (i) identification data including an identifier of the vehicle, (ii) a location of the vehicle, (iii) a direction of travel of the vehicle, and (iv) a counter value.

Upon receipt of a packet from a nearby vehicle, a given vehicle determines if the given vehicle is already identified in the packet and is traveling in substantially the same direction as the nearby vehicle, as indicated in the packet. If the given vehicle is not already identified in the packet and if the given vehicle is traveling in the same direction, the given vehicle generates a next packet. To generate the next packet, the given vehicle increments the counter value and adds an identifier of the given vehicle to the identification data so as to establish modified identification data. The given vehicle then broadcasts, for receipt by any nearby vehicles, a next packet containing at least (i) the modified identification data, (ii) a location of the given vehicle, (iii) a direction of travel of the given vehicle, and (iv) the incremented counter value. Additionally, the given vehicle transmits to the nearby vehicle an acknowledgement of the initially received packet.

The given vehicle is further equipped to transmit a reporting packet, containing information usable by the traffic monitoring server to determine vehicular traffic, via the radio access network to the traffic monitoring server. The transmitting of the reporting packet may be conditioned upon not receiving an acknowledgement after broadcasting a next packet. The transmitting of the reporting packet may also be conditioned upon a determination that the incremented counter value meets a threshold.

Each vehicle may be further equipped to broadcast an initial packet that is not based on data received from any nearby vehicles. Such an initial packet may include (i) an identifier of the vehicle broadcasting the initial packet, (ii) a location of the vehicle broadcasting the initial packet, (iii) a direction of travel of the vehicle broadcasting the initial packet, and (iv) a counter value of one.

An exemplary traffic monitoring module installed in a vehicle may facilitate the collection of information to send to a traffic monitoring server. The module may include, among other components, a first wireless transceiver, a second wireless transceiver, a processor, data storage, and program instructions stored in the data storage and executable by the processor. The first wireless transceiver may be operable to engage in direct wireless communication with traffic monitoring modules in nearby vehicles, and the second wireless transceiver may be operable to engage in wireless communication with the radio access network. The module may also have a speedometer to determine its speed and a compass to determine its direction and location.

The program instructions contained by the traffic monitoring module may allow the module to perform multiple functions. The module may receive a packet wirelessly transmitted from the nearby vehicle and may wirelessly broadcast a next packet, both via the first wireless transceiver. The module may also transmit, via the first transceiver, an acknowledgement of a received packet. Additionally, the module may transmit a reporting packet via the second wireless transceiver to the radio access network for transmission in turn to the traffic monitoring server.

DETAILED DESCRIPTION

Exemplary Architecture

Figure 1:
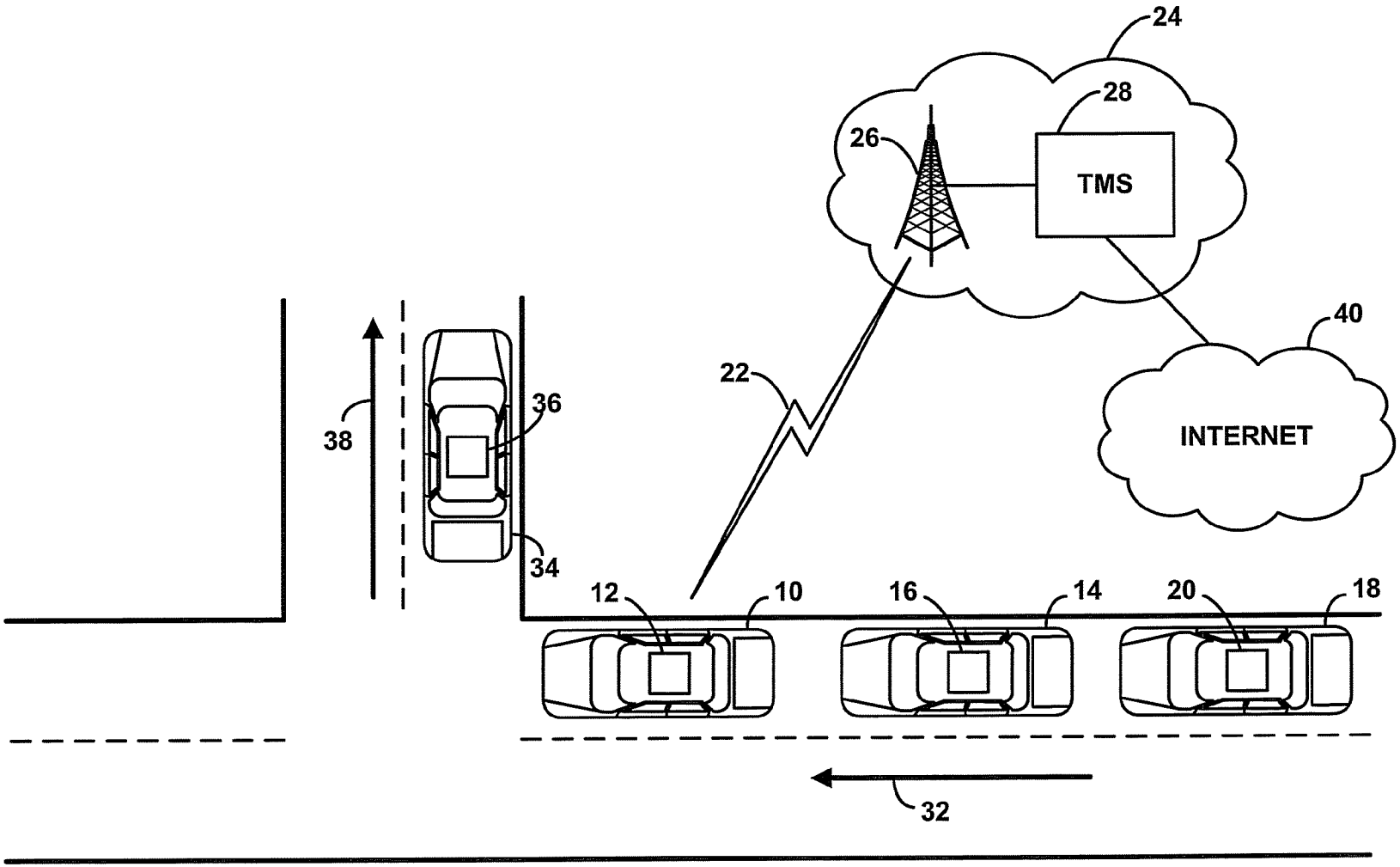
FIG. 1 is a block diagram of a system in which an exemplary embodiment may be implemented.

FIG. 1 depicts an exemplary network for vehicular traffic congestion monitoring. This network configuration should not be taken to limit the invention. A vehicle 10, approaching an intersection 30 and traveling in a direction 32, may be equipped with a traffic monitoring module 12. Vehicles 14 and 18, also traveling in direction 32, may be equipped with traffic monitoring modules 16 and 20, respectively. A vehicle 34 is traveling away from intersection 30 in a direction 38, perpendicular to direction 32, and vehicle 34 may be equipped with a traffic monitoring module 36. Traffic monitoring modules 12, 16, 20, and 36 may communicate with each other using short-range wireless protocols. Such short-range protocols are known in the art and may include, by way of example, Bluetooth, UWB (ultra wide band), Zigbee, and IEEE 802.11.

Traffic monitoring modules 12, 16, 20, and 36 may also communicate over an air interface 22 with a RAN 24 using long-range wireless protocols. Such long-range wireless protocols are known in the art and may include, by way of example, CDMA, iDEN, TDMA, AMPS, GSM, GPRS, UMTS, EDGE, WiMAX, LTE, and satellite. A BTS 26 may include a tower with one or more antennas that radiate to define air interface 22. BTS 26 may also be connected to a traffic monitoring server 28, which may be configured to collect and process information relating to vehicular traffic congestion. Traffic monitoring server 28 may be communicatively coupled to other networks, such as a packet switched network, shown as the Internet 40.

Figure 2:
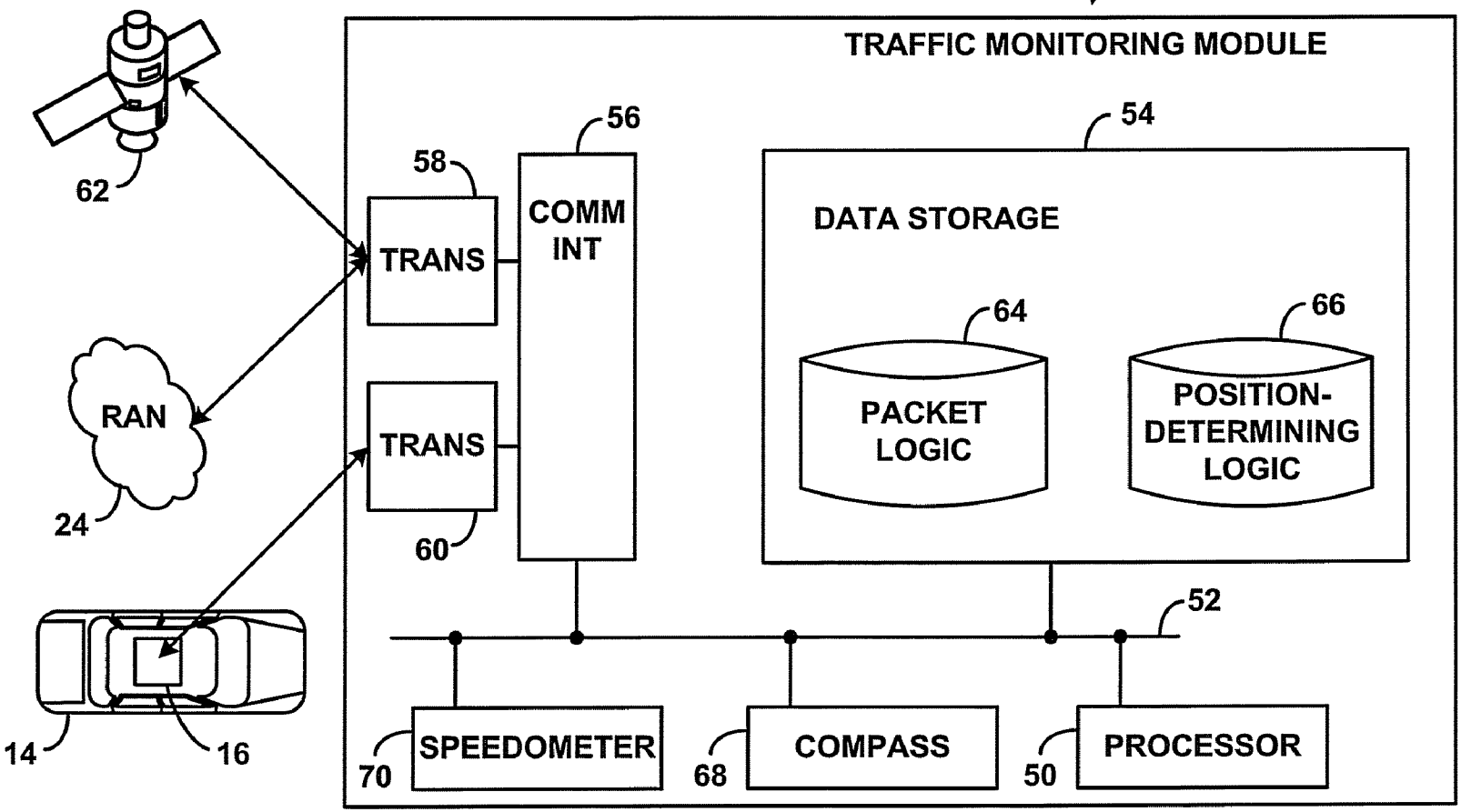
FIG. 2 is a block diagram of an exemplary traffic monitoring module.

FIG. 2 is a block diagram of exemplary traffic monitoring module 12. A processor 50 communicates with other system components, including data storage 54 and a communication interface 56, over a system bus 52. A speedometer 70 may indicate the speed at which vehicle 10 is traveling and may be connected to system bus 52. A compass 68 may also be connected to system bus 52.

Communication interface 56 manages communications between traffic monitoring module 12 and other elements in the network. For instance, a long-range transceiver 58 may communicate with RAN 24 and a satellite 62. Long-range transceiver 58 may comprise two separate radios—one radio adapted to communicate with RAN 24, and one radio adapted to communicate with satellite 62—integrated into a single chipset. A short-range transceiver 60 may communicate with the traffic monitoring modules of nearby vehicles, such as traffic monitoring module 16 of vehicle 14. Messages received through transceivers 58 and 60 may be communicated through communication interface 56 and over system bus 52 to processor 50. Similarly, messages to be transmitted by transceivers 58 and 60 may originate from processor 50 and travel over system bus 52 and through communication interface 56 to the transceivers.

Data storage 54 may contain system logic, including programming instructions, accessible by processor 50 via system bus 52. Such system logic may include packet logic 64 and position determination logic 66. Packet logic 64 may include instructions for generating, analyzing, manipulating, receiving, and transmitting data packets related to monitoring vehicular traffic congestion. Position determination logic 66 may include instructions for determining the geographical position of vehicle 10 using information received from satellite 62 and how to determine the direction in which vehicle 10 is traveling. Alternatively, compass unit 68 may indicate the direction in which vehicle 10 is traveling and may be connected to system bus 52.

Data Packets

Figure 3:
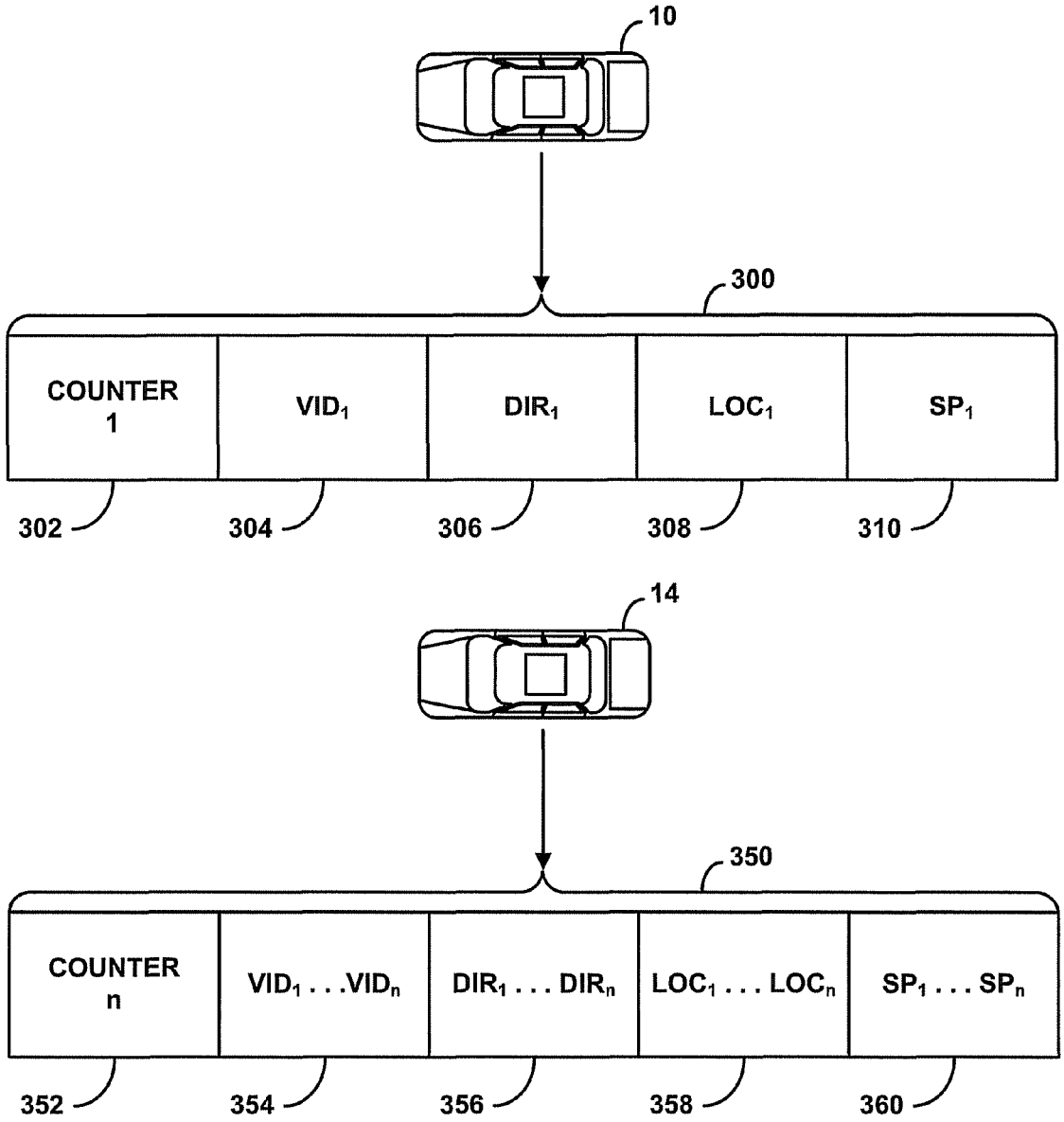
FIG. 3 is a block diagram of exemplary data packets.

FIG. 3 depicts two different data packets that may be transmitted and received by vehicles in a preferred embodiment of the invention, an initial packet 300 and a propagated packet 350. Packet 300 is an initial data packet, which may be generated and transmitted by an initial car, here car 10. Packet 300 may consist of five data fields, a counter 302 and data arrays 304, 306, 308, and 310. Counter 302 indicates the number of vehicles that have processed packet 300, and because packet 300 is an initial data packet, counter 302 has a value of 1, indicating that it only contains information from one vehicle, vehicle 10. Identification array 304 identifies all vehicles that have processed packet 300. Direction array 306 indicates the respective directions of all vehicles that have processed packet 300. Location array 308 indicates the respective locations of all vehicles that have processed packet 300, and speed array 310 indicates the respective speeds of all vehicles that have processed packet 300. Because packet 300 is an initial data packet only processed by vehicle 10, each of the four arrays only contains one value, corresponding to information about vehicle 10, either identification, direction, location, or speed.

Packet 350 is a propagated packet that has been processed and broadcast by n vehicles, here the nth vehicle being vehicle 14. Packet 350 has the same five data fields as packet 300; however, each of the data fields of packet 350 has been incrementally updated to reflect information about each of the vehicles that has processed packet 350. For example, counter 352 has a value of n to indicate that n vehicles have processed packet 350. When originally transmitted, packet 350 was packet 300, and therefore the first value, the value with a subscript of 1, in each of the four data arrays—identification array 354, direction array 356, location array 358, and speed array 360—indicates information from the initial vehicle, vehicle 10. The nth value in each array corresponds to information about the nth vehicle 14, and intervening values correspond to the vehicles that processed packet 350 between initial vehicle 10 and nth vehicle 14.

Exemplary Method

Figure 4:
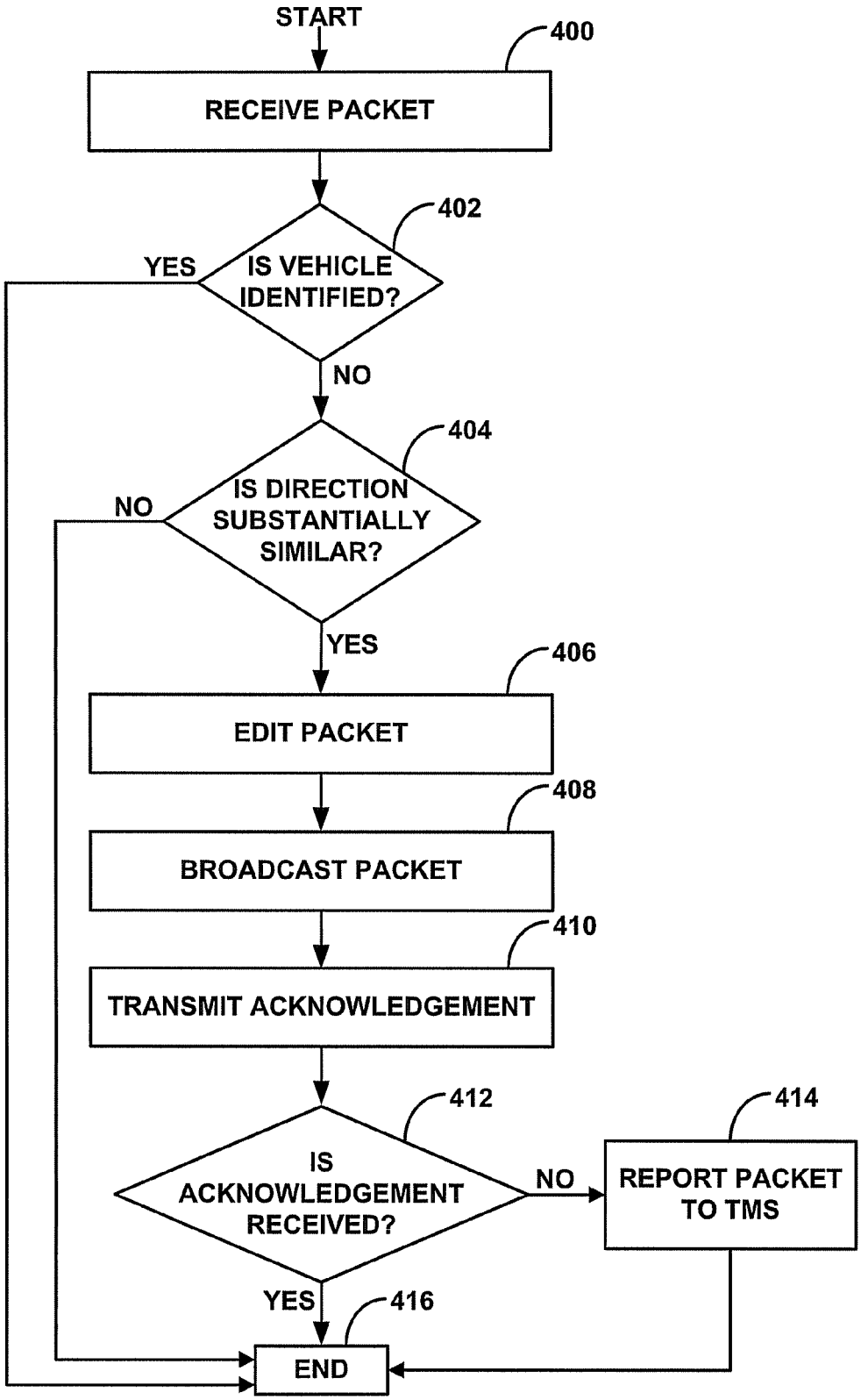
FIG. 4 is a flow diagram depicting functions carried out in accordance with an exemplary method.

FIG. 4 is a flow diagram of the behavior, in accordance with an exemplary method, of a receiving vehicle that receives a data packet, either an initial data packet or a propagated data packet, in step 400. The operations described in FIG. 4 may be performed by the receiving vehicle's traffic monitoring module or another appropriate instrumentality on the receiving vehicle. For simplicity, both the vehicle and the module or instrumentality performing the functions will be referred to as "the receiving vehicle" for this discussion.

In step 402, the receiving vehicle may analyze the received data packet to determine if the receiving vehicle is already identified in the packet. If the receiving vehicle is already identified in the packet, the method may then proceed from step 402 to end step 416 signifying that the receiving vehicle need not to perform any further operations on the received packet. If the receiving vehicle is not already identified in the packet, the receiving vehicle may proceed from step 402 to step 404, in which the receiving vehicle may analyze the direction information in the packet to determine if the previous vehicles that have processed the packet were traveling in substantially the same direction as the receiving vehicle. Step 404 may ensure that vehicles may edit those packets containing information relevant to the receiving vehicle's direction of travel and may ignore irrelevant packets containing information regarding other directions of travel.

Once the receiving vehicle has determined by that it is not already identified in the packet and that the packet refers to a relevant direction of travel, the receiving vehicle may add information to the packet in step 406. For example, in step 406, the receiving vehicle may increment the counter by one. The receiving vehicle may also update the identification information of the packet to include identification information of the receiving vehicle. In alternative embodiments, the receiving vehicle may also edit the packet in step 406 to include direction, location, and speed information corresponding to the receiving vehicle.

In step 408, the receiving vehicle may broadcast the edited packet to other nearby vehicles. In step 410, the receiving vehicle may transmit an acknowledgement of the received packet to the vehicle that initially transmitted the packet to the receiving vehicle. In step 412, the receiving vehicle may, in turn, wait for an acknowledgement from another vehicle that that vehicle has received and updated the edited packet. If the receiving vehicle receives an acknowledgement in step 412, the receiving vehicle has no further responsibilities with respect to the edited packet, and the receiving vehicle may end its processing of the packet in step 416.

The lack of an acknowledgement received by the receiving vehicle in step 412 may signal to the receiving vehicle that it is the last vehicle that will edit the packet. For example, the receiving vehicle may be the last vehicle because the receiving vehicle is not in close enough proximity to other vehicles that other vehicles would have received the broadcast packet. Alternatively, other vehicles may have received the broadcast packet but determined that their identification information was already included in the packet, signaling to those vehicles that they had already edited the packet and need not edit it again.

If the receiving vehicle does not receive an acknowledgement and is therefore the last vehicle to edit the packet, the receiving vehicle may transmit a reporting packet to the traffic monitoring server in step 414. In one embodiment, the receiving vehicle may transmit the entire edited packet as the reporting packet to the traffic monitoring server using the long-range transceiver in its traffic monitoring module. Alternatively, the receiving vehicle may create a separate reporting packet using a subset of the information in the edited packet—for instance, including counter, direction, and location information and omitting vehicle identification information—and the receiving vehicle may then transmit the reporting packet to the traffic monitoring server. After the receiving vehicle has reported information to the traffic monitoring server, the receiving vehicle may end its packet processing in step 416.

Alternatively, reporting to the traffic monitoring server may be contingent upon the counter value rather than the receipt of an acknowledgement. In that embodiment, a receiving vehicle would determine if the counter value had reached a threshold value after the receiving vehicle had edited the packet. If such a threshold value was reached, the receiving vehicle would transmit a reporting packet to the traffic monitoring server regardless of whether nearby vehicles existed that had not edited the packet.

Given the configuration of FIG. 1, traffic monitoring module 12 may generate, in accordance with the exemplary method, an initial data packet, such as packet 300, with information from vehicle 10 and wirelessly broadcast the packet to nearby vehicles using transceiver 60. Vehicle 14 may then receive initial data packet 300 transmitted by initial vehicle 10.

After receiving the data packet, vehicle 14 may perform the functions depicted in FIG. 4. For example, vehicle 14 may determine in step 402 that it is not included in packet 300 because there is no identifier corresponding to vehicle 14 in identification array 304. Subsequently, in step 404, vehicle 14 may determine that its direction is substantially similar to that of vehicle 10 by comparing its own direction information with the information in direction array 306.

In step 406, vehicle 14 may then augment initial packet 300 to create propagated packet 350 by incrementing the counter to 2 and adding identification, direction, location, and speed information to the appropriate data arrays. In step 408, vehicle 14 may then transmit a propagated packet to other nearby vehicles, and in step 410, vehicle 14 may transmit an acknowledgement back to vehicle 10.

Vehicle 18 may then receive the packet broadcast by vehicle 14 and also perform the functions depicted in FIG. 4. Vehicle 18 may first determine in step 402 that it is not included in propagated packet 350 because there is no identifier corresponding to vehicle 14 in identification array 354. Subsequently, in step 404, vehicle 18 may determine that its direction is substantially similar to that of vehicles 10 and 14 by comparing its own direction information with the information in direction array 356. In step 406, vehicle 18 may then augment propagated packet 350 and generate a next propagated packet by incrementing the counter to 3 and adding identification, direction, location, and speed information to the appropriate data arrays. In step 408, vehicle 18 may then transmit the next propagated packet to other nearby vehicles, and in step 410, vehicle 18 may transmit an acknowledgement back to vehicle 14.

Vehicle 18 will not receive an acknowledgement itself of the transmitted propagated packet in step 412. This is because none of the other three vehicles in FIG. 1 will edit the propagated packet. If vehicle 10 received the packet, vehicle 10 would identify itself as already having processed the packet, and vehicle 10 would discard the packet without editing it or transmitting it to the traffic monitoring server. Vehicle 14 would behave similarly to vehicle 10 as vehicle 14 has also already edited the propagated packet. If vehicle 34 received the packet, it would discard the packet after it determined, in step 404, that it is not traveling in substantially the same direction as the other vehicles that have processed the packet, as vehicle 34 is traveling in direction 38, perpendicular to direction 32, the direction of travel of vehicles 10, 14, and 18.

After vehicle 18 does not receive an acknowledgement in step 412, perhaps after a waiting period has elapsed, vehicle 18 may report the propagated packet to the traffic monitoring server in step 414, including at least the counter, the direction information, and the location information. Once traffic monitoring server 38 receives the reporting packet, it may access appropriate maps to translate the reporting packet into the information that three vehicles are currently traveling in direction 32 at intersection 30.

Traffic Monitoring Server

Generally, once the traffic monitoring server receives a reporting packet, the information from the reporting packet may be used to determine traffic patterns. For example, if the reporting packet contains counter, direction, and location information, the traffic monitoring server may correlate the location information to a location on a map. The traffic monitoring server may then determine that traffic congestion does or does not exist in that location by analyzing the number of vehicles traveling in substantially the same direction around the location. Alternatively, if the reporting packet also contains speed information, the traffic monitoring server may analyze the speed information to determine if traffic congestion exists. If the traffic monitoring server receives multiple reporting packets from multiple vehicles in multiple locations, the traffic monitoring server may collect all of the information contained in those reporting packets to determine traffic patterns around a broad area.

The traffic monitoring server may also transmit messages regarding traffic patterns. For example, multiple traffic monitoring servers may also be communicatively coupled with each other to share traffic monitoring information. Alternatively, the traffic monitoring server may transmit traffic information to a vehicle equipped to receive traffic information from the traffic monitoring server. The vehicle may then present relevant traffic information to the driver of the vehicle, for example by displaying a map with traffic icons on a graphical screen embedded in the dashboard of the vehicle.

Exemplary embodiments of the present invention have been described above. Those skilled in the art will understand, however, that changes and modifications may be made to the embodiments described without departing from the true scope and spirit of the present invention, which is defined by the claims.

The invention claimed is:

1. A method of monitoring vehicular traffic comprising:

receiving at a given vehicle a packet wirelessly broadcast from a nearby vehicle, wherein the packet contains at least (i) identification data including an identifier of the nearby vehicle, (ii) a location of the nearby vehicle, (iii) a direction of travel of the nearby vehicle, and (iv) a counter value;

upon receipt of the packet, determining if the given vehicle is not already identified in the packet and if the given vehicle is traveling in substantially the same direction as the received packet indicates the nearby vehicle is traveling, and, only if so, (A) incrementing the counter value, adding an identifier of the given vehicle to the identification data so as to establish modified identification data, and then wirelessly broadcasting a next packet containing at least (i) the modified identification data, (ii) a location of the given vehicle, (iii) a direction of travel of the given vehicle, and (iv) the incremented counter value, and (B) transmitting to the nearby vehicle an acknowledgement of the received packet; and transmitting a reporting packet via a radio access network to a traffic monitoring server, wherein contents of the reporting packet are usable by the traffic monitoring server as a basis to determine vehicular traffic.

2. The method of claim 1, further comprising:

conditioning the transmitting of the reporting packet to the traffic monitoring server on a determination that the given vehicle does not receive an acknowledgement of the next packet.

3. The method of claim 1, further comprising:

conditioning the transmitting of the reporting packet to the traffic monitoring server on a determination that the incremented counter value meets a threshold.

4. A system for monitoring vehicular traffic, the system comprising at least a given vehicle operative to carry out functions comprising:

receiving a packet wirelessly broadcast from a nearby vehicle, wherein the packet contains at least (i) identification data including an identifier of the nearby vehicle, (ii) a location of the nearby vehicle, (iii) a direction of travel of the nearby vehicle, and (iv) a counter value;

upon receipt of the packet, determining if the given vehicle is not already identified in the packet and if the given vehicle is traveling in substantially the same direction as the received packet indicates the nearby vehicle is traveling, and, only if so, (A) incrementing the counter value, adding an identifier of the given vehicle to the identification data so as to establish modified identification data, and then wirelessly broadcasting a next packet containing at least (i) the modified identification data, (ii) a location of the given vehicle, (iii) a direction of travel of the given vehicle, and (iv) the incremented counter value, and (B) transmitting to the nearby vehicle an acknowledgement of the received packet; and transmitting a reporting packet via a radio access network to a traffic monitoring server, wherein contents of the reporting packet are usable by the traffic monitoring server as a basis to determine vehicular traffic.

5. The system of claim 4, wherein the given vehicle conditions transmitting of the reporting packet to the traffic monitoring server on the given vehicle not receiving an acknowledgement of the next packet.

6. The system of claim 4, wherein the given vehicle conditions transmitting of the reporting packet to the traffic monitoring server on the incremented counter value meeting a threshold.

7. The system of claim 4, wherein the incremented counter is usable by the traffic monitoring server as an indication of vehicular traffic severity.

8. The system of claim 4, wherein the given vehicle has a traffic monitoring module that performs the functions.

9. The system of claim 8, wherein the traffic monitoring module comprises:

a first wireless transceiver for engaging in direct wireless communication with traffic monitoring modules in nearby vehicles;

a second wireless transceiver for engaging in wireless communication with the radio access network;

a processor;

data storage; and program instructions stored in the data storage and executable by the processor to perform the functions, wherein (i) receiving the packet wirelessly transmitted from the nearby vehicle comprises receiving via the first wireless transceiver the packet wirelessly transmitted from the nearby vehicle, (ii) wirelessly broadcasting a next packet comprises wirelessly broadcasting the next packet via the first wireless transceiver, (iii) transmitting the acknowledgement of the received packet comprises transmitting via the first transceiver the acknowledgement of the received packet, and (iv) transmitting at least the next packet via a radio access network to the traffic monitoring server comprises transmitting a reporting packet via the second wireless transceiver to the radio access network for transmission in turn to the traffic monitoring server.

10. The system of claim 9, wherein the traffic monitoring module further comprises a satellite-based positioning system receiver and associated logic operable to determine the location of the given vehicle.

11. The system of claim 10, wherein the associated logic is further operable to determine the direction of travel of the given vehicle.

12. The system of claim 9, wherein the traffic monitoring module further comprises a compass operable to indicate the direction of travel of the given vehicle.

13. The system of claim 9, wherein the first transceiver wirelessly communicates using a protocol selected from the group consisting of BLUETOOTH, UWB (ultra wide band), ZIGBEE, and 802.11, and wherein the second transceiver wirelessly communicates using a protocol selected from the group consisting of CDMA, iDEN, TDMA, AMPS, GSM, GPRS, UMTS, EDGE, WiMAX, LTE and satellite.

14. The system of claim 4, wherein the identification data in the received packet further includes an identifier of a vehicle from which the nearby vehicle received an earlier packet.

15. The system of claim 4, wherein the next packet further contains the location of the nearby vehicle and the direction of travel of the nearby vehicle.

16. The system of claim 15, wherein the received packet further indicates a speed at which the nearby vehicle is traveling, and wherein the next packet indicates the speed that the received packet indicates the nearby vehicle is traveling as well as a speed at which the given vehicle is traveling.

17. The system of claim 16, wherein the received packet further contains a timestamp of the received packet, and wherein the next packet contains the timestamp of the received packet as well as a timestamp of the next packet.

18. A system for monitoring vehicular traffic comprising:

a plurality of vehicles each equipped to wirelessly communicate directly with nearby vehicles and further equipped to wirelessly communicate via a radio access network with a traffic monitoring server, wherein each given vehicle of the plurality is equipped to receive a packet broadcast from another vehicle, wherein the packet contains at least (i) identification data including an identifier of the other vehicle, (ii) a location of the other vehicle, (iii) a direction of travel of the other vehicle, and (iv) a counter value, wherein, upon receipt of the packet, the given vehicle determines if the given vehicle is not already identified in the packet and if the given vehicle is traveling in substantially the same direction as the received packet indicates the other vehicle is traveling, and, only if so, (A) increments the counter value, adds an identifier of the given vehicle to the identification data so as to establish modified identification data, and then broadcasts for receipt by any nearby vehicles a next packet containing at least (i) the modified identification data, (ii) a location of the given vehicle, (iii) a direction of travel of the given vehicle, and (iv) the incremented counter value, and (B) transmits to the other vehicle an acknowledgement of the received packet, wherein the given vehicle is further equipped to transmit a reporting packet via the radio access network to the traffic monitoring server, whereby contents of the reporting packet are usable by the traffic monitoring server to determine vehicular traffic.

19. The system of claim 18, wherein the given vehicle conditions transmitting of the reporting packet to the traffic monitoring server on the given vehicle not receiving an acknowledgement of the next packet.

20. The system of claim 18, wherein the given vehicle conditions transmitting of the reporting packet to the traffic monitoring server on the incremented counter value meeting a threshold.

21. The system of claim 18, wherein each vehicle is further equipped to broadcast an initial packet that is not based on data received from any nearby vehicles, and to include in the initial packet (i) an identifier of the vehicle broadcasting the initial packet, (ii) a location of the vehicle broadcasting the initial packet, (iii) a direction of travel of the vehicle broadcasting the initial packet, and (iv) a counter value of one.

* * * * *